United States Patent [19]

Kuenstler

[11] 4,123,922

[45] Nov. 7, 1978

[54] LOCKABLE DESK RECEPTACLE

[76] Inventor: Paul G. Kuenstler, 6519 Mapleridge, Houston, Tex. 77081

[21] Appl. No.: 728,954

[22] Filed: Oct. 1, 1976

[51] Int. Cl.[2] ..... E05B 73/00

[52] U.S. Cl. ..... 70/58; 206/1.5; 211/4; 248/203

[58] Field of Search ..... 70/57, 58, 61, 62, 63, 70/158, 163, 164; 211/4, 8; 248/203; 206/1.5, 216, 305, 320, 560, 807

[56] References Cited

U.S. PATENT DOCUMENTS

| | | | |
|---|---|---|---|
| 1,825,726 | 10/1931 | Gredell | 70/164 X |
| 1,914,276 | 6/1933 | Moore | 211/4 |
| 2,188,419 | 1/1940 | Saviteer | 70/164 X |
| 3,200,958 | 8/1965 | Hudgeons et al. | 211/4 |
| 3,495,716 | 2/1970 | Gregory | 211/4 |
| 3,664,163 | 5/1972 | Footie | 70/58 |
| 3,771,338 | 11/1973 | Raskin | 70/58 |
| 3,895,768 | 7/1975 | Scheck | 248/203 X |
| 3,984,075 | 10/1976 | Bahner et al. | 70/58 X |
| 3,985,275 | 10/1976 | Allen | 70/58 X |
| 3,990,276 | 11/1976 | Shontz | 70/58 |

FOREIGN PATENT DOCUMENTS

| | | | |
|---|---|---|---|
| 542,273 | 1/1942 | United Kingdom | 70/164 |

*Primary Examiner*—Thomas J. Holko
*Attorney, Agent, or Firm*—James L. Jackson

[57] ABSTRACT

A positionable receptacle is provided for receiving and securably retaining an article, and means for securing the receptacle to an immovable object is provided. A wall structure is provided to define a depression within which the article is receivable. A locking means is provided for securing the article within the receptacle, and a keeper means is provided to retain the locking means in the locked position, which keeper means is removable only after removal of the securing means from the receptacle.

13 Claims, 13 Drawing Figures

FIG. 6
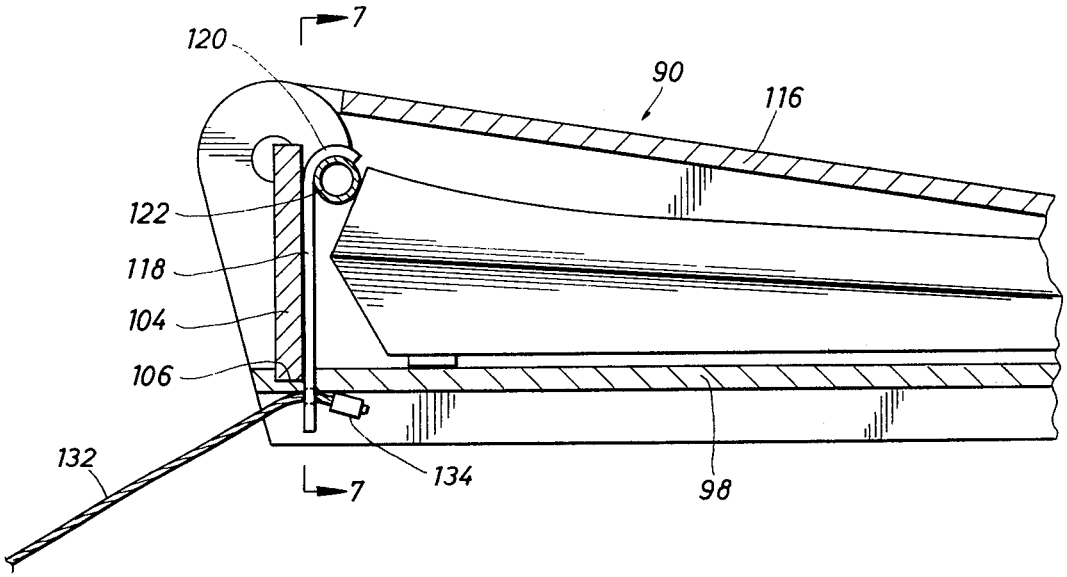
FIG. 7
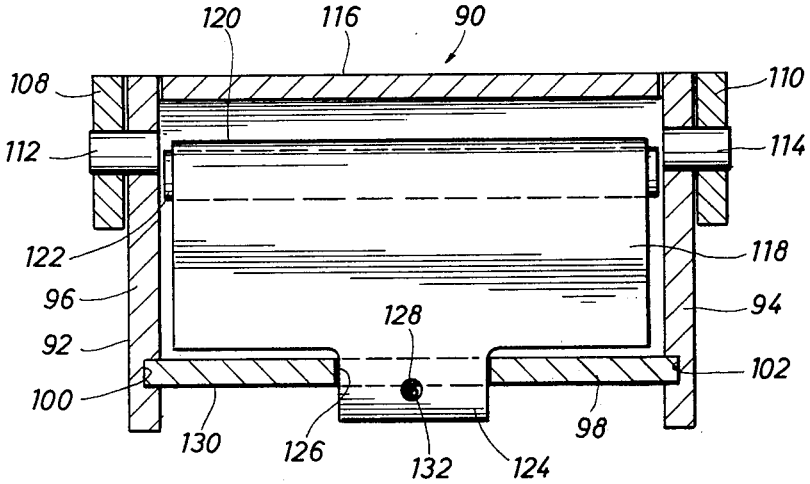
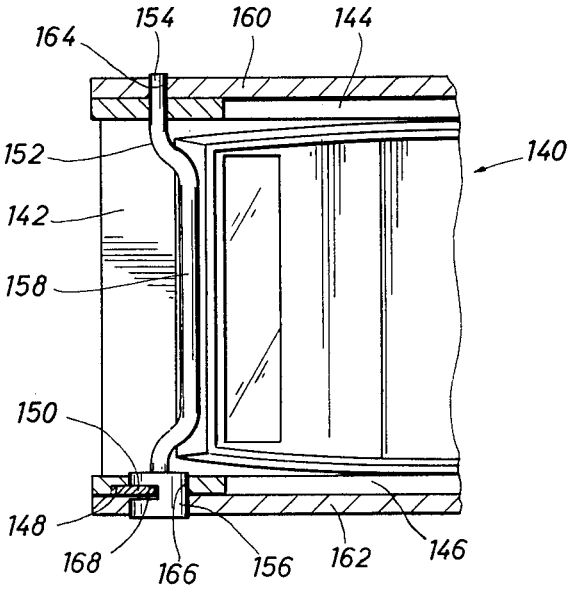
FIG. 8

FIG. 9
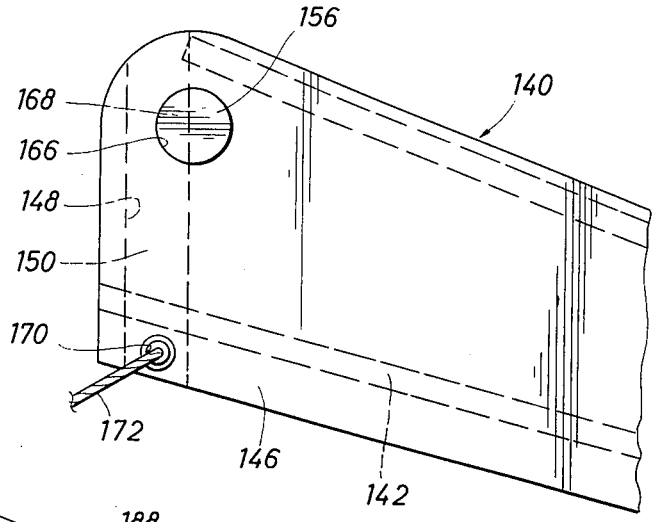
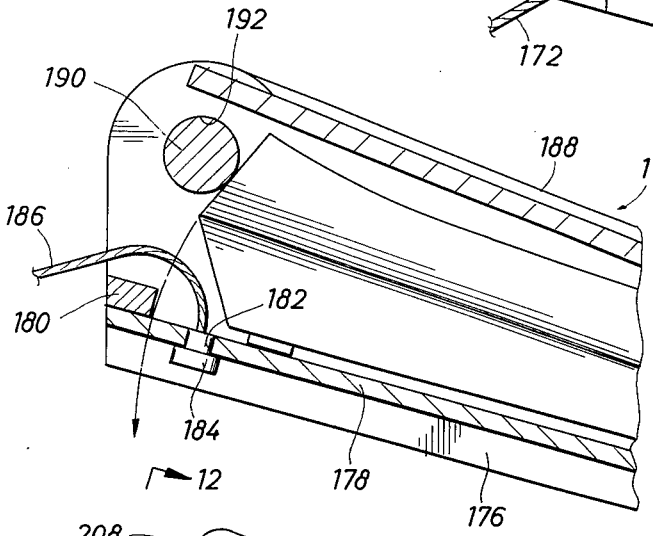
FIG. 10
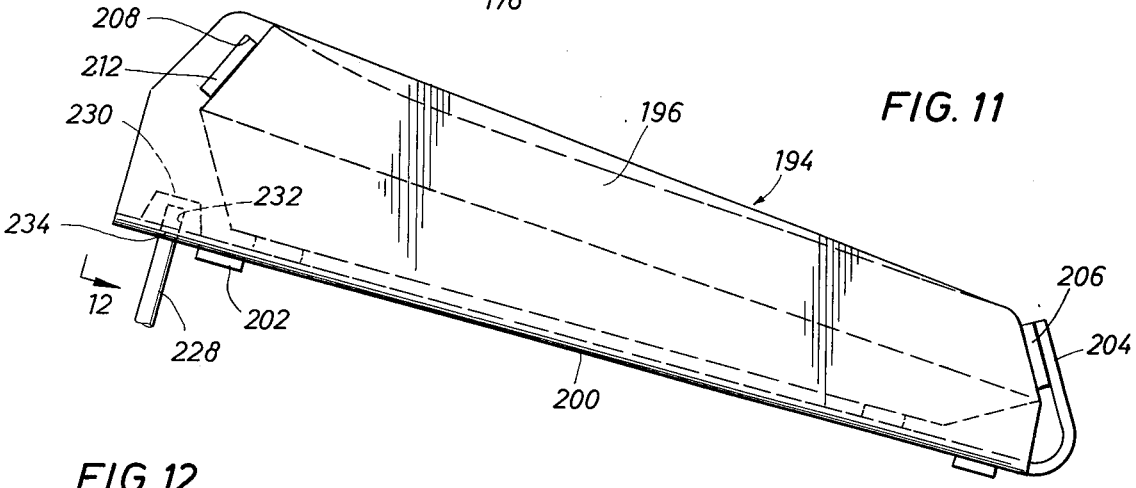
FIG. 11
FIG. 12
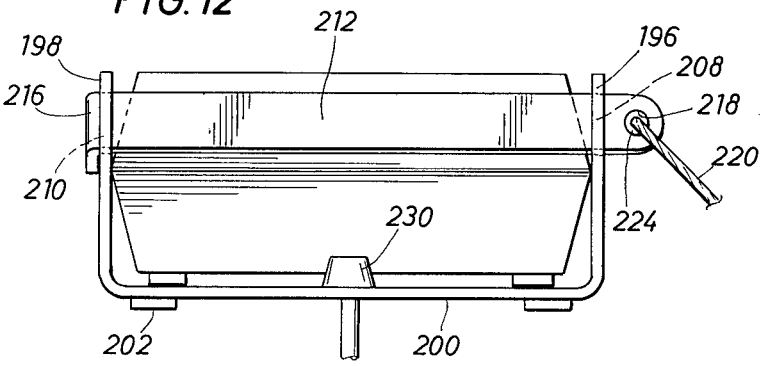
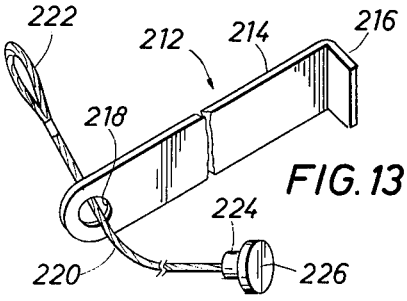
FIG. 13

LOCKABLE DESK RECEPTACLE

FIELD OF THE INVENTION

This invention relates generally to security devices for small objects and relates more particularly to a receptacle for securing objects, such as an electronic calculator, to an immovable object, such as a desk. The preferred embodiment of the invention may be in the form of a positionable receptacle wherein the receptacle is secured to the desk by means of a lockable lanyard.

BACKGROUND OF THE INVENTION

Recent years have evidenced the increasing popularity of small portable electronic calculators. Most of these calculators are operable by battery and/or 115 volt A.C. electric current such as is provided by a normal wall outlet. Most provide battery recharging capabilities. Prices for these calculators vary but suffice it to say that the greater the numerical capabilities of these calculators, the greater their cost. Specialized calculators are even available for use in computations in such fields as engineering, real estate, mathematics, etc.

The portability and compactness of these calculators are prime features of their attractiveness. However, these same features also present drawbacks: the portability and compactness of modern calculators make them easy objects of theft. The result has been that owners of electronic calculators must take care to avoid theft of their calculators by either carrying them on their persons or locking them in their office desks or carrying them home at night. This is obviously not a very efficient solution to the theft problem.

Another problem posed by these portable calculators is that their small size and typically flat shape enable them to be easily covered up and misplaced when laid on a working executive's or student's desk.

These drawbacks and problems are overcome with the present invention, and commercially acceptable embodiments of a securable receptacle and the like are herein provided which are not only fully capable of securing most types of portable calculators, but which are also capable of other tasks, such as serving as a decorative holder and mounting a steno pad or table of formulae.

An advantageous feature of the present invention is its ability to provide an inexpensive theft-preventing receptacle capable of securing a portable electronic calculator to a desk or other immovable object. By so doing, the advantages of compact calculators are made available to a user without the disadvantage of easy misplacement or theft that is typically offered by the compactness and lightness of portable calculators and other small objects.

It is a further feature that the present invention provides for quick and easy insertion and removal of a portable calculator from the receptacle.

It is also a feature of the present invention that in one embodiment the receptacle is movable and positionable for easy access and use while at the same time being secured.

It is a feature to provide a flexible metallic securing lanyard having a button at one end for retaining the receptacle locking means in a locked position and being securable to an immovable object at the other end, and said lanyard requiring total disengagement from the immovable object and subsequent removal from the receptacle before the receptacle locking means may be disengaged.

Another feature of the present invention is to provide a keeper means for directly retaining the locking bar in the locked position, said keeper being received in a slot in the locking bar when the locking bar is in the locked position.

It is a further advantageous feature of the present invention that the keeper means is positionable in cooperative relationship with the receptacle wall structure, said wall structure and keeper means having registrable apertures for receiving the lanyard button.

It is also a feature of the present invention in its preferred embodiment that the locking bar is an elongated cylinder rotatable to either a locking position or a releasing position.

These and other features and advantages of the present inventon will become apparent from the following detailed description, wherein reference is made to the Figures in the accompanying drawings.

SUMMARY OF INVENTION

This invention concerns a receptacle for securing an object, such as an electronic calculator, to an immovable object, such as a desk. The receptacle structure includes a wall structure defining a chamber or enclosure into which an electronic calculator or other suitable object can be placed. The receptacle preferably includes a locking element positionable at one extremity of the receptacle that interrelates structurally with the calculator or object in such a way that the calculator or object cannot be removed. The locking device may take other convenient forms depending upon the structural character of the object and enclosure without departing from the spirit and scope of the invention. Certain embodiments of the invention may incorporate a flattened projection as an integral part of the locking element for insertion into the bottom portion of the receptacle whereby the locking bar may be maintained in the locked position thereof by insertion of a securing cord and locking button into an aperture in the flattened projection. In a preferred embodiment of this invention a keeper may be provided for retaining the locking bar in the locked position, the keeper being inserted generally perpendicular to the locking bar into a slot in the locking bar when the locking bar is in the locked position. Preferably, the keeper is separate from the locking bar, but in certain embodiments of the invention may be affixed to the locking bar so as to form one integral piece. The keeper has an aperture at the end opposite the locking bar, such that the aperture is registrable with an aperture in the wall structure when the keeper is retaining the locking bar in the secured position. A lanyard element may be provided for securing the receptacle to a desk or other immovable object. The lanyard has a locking button at one end suitable for simultaneous insertion into the registrable apertures of the key and wall structure, so that the keeper is held in place, thereby retaining the locking bar in the locked position thereof. The locking button and lanyard are so constructed that the keeper is not freed until the lanyard is unsecured from the desk or other immovable object and drawn through the registered apertures following removal of the button. Certain embodiments of the invention may have the button and lanyard similarly insertable and removable into an aperture in a flattened projection portion of the locking bar. Means may also be provided for elevating the receptacle from a desk or other plane and for maintaining it in a level position. Further means may be provided for turning the locking bar from the open position to the locking position and back again, thereby allowing receipt and removal of an electronic calculator or other article.

Any type of suitable material may be used to construct the present invention. However, it is envisioned that inexpensive and readily obtainable materials such as durable plastics or metals or wood will be employed. In one embodiment of the invention the receptacle may be built into a desk top, in which case the invention may be made partially or wholly of the same material as the desk.

IN THE DRAWINGS

FIG. 6 is a partial sectional view of a positionable receptacle structure representing an alternate embodiment of the present invention and showing a miniature calculator device being retained in locked condition within the receptacle structure.

FIG. 7 is a sectional view of the receptacle structure of FIG. 6 with the section being taken along line 7—7 in FIG. 6.

FIG. 8 is a partial sectional view of a positionable receptacle structure representing another embodiment of the present invention and showing a miniature calculator in full line being retained in locked position within the receptacle structure.

FIG. 9 is a partial side elevational view of the protective receptacle structure of FIG. 8.

FIG. 10 is a fragmentary sectional view of a protective receptacle structure representing an even further embodiment of the present invention and illustrating a miniature calculator device being retained in locked rotation within the receptacle.

FIG. 11 is a sectional view of a protective receptacle structure representing another embodiment of this invention with the receptacle being formed basically of folded sheet material and showing a calculator being retained in locked relation within the receptacle.

FIG. 12 is an end view of the protective receptacle structure of FIG. 11 taken along line 12—12 of FIG. 11.

FIG. 13 is an isometric view of the locking element utilized in conjunction with the protective receptacle structure of FIGS. 11 and 12.

DESCRIPTION OF PREFERRED EMBODIMENTS

Figure 1:
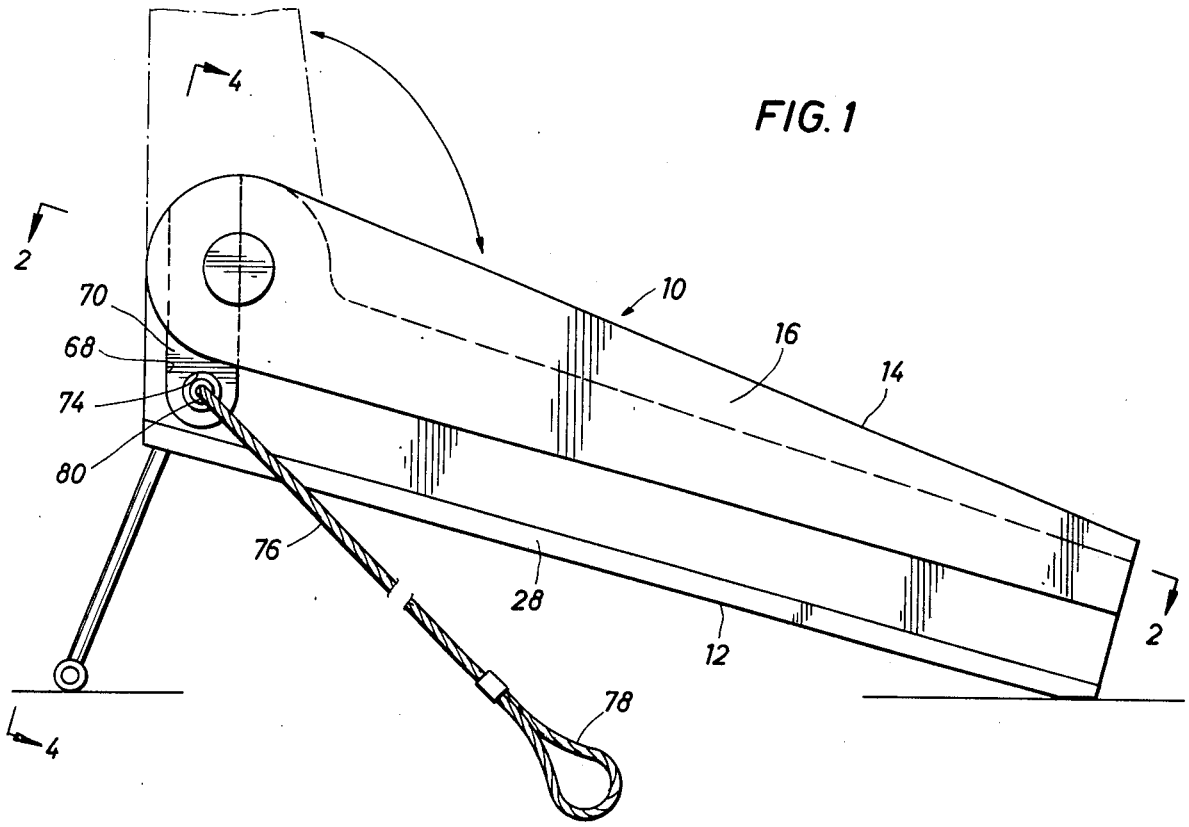
FIG. 1 is an elevational view of a receptacle structure manufactured in accordance with the present invention and showing the receptacle in full line having one extremity thereof elevated and in broken line showing the pivotal cover of the receptacle being rotated to a position exposing a calculator or other object within the receptacle for visual inspection and manipulation.
Figure 3:
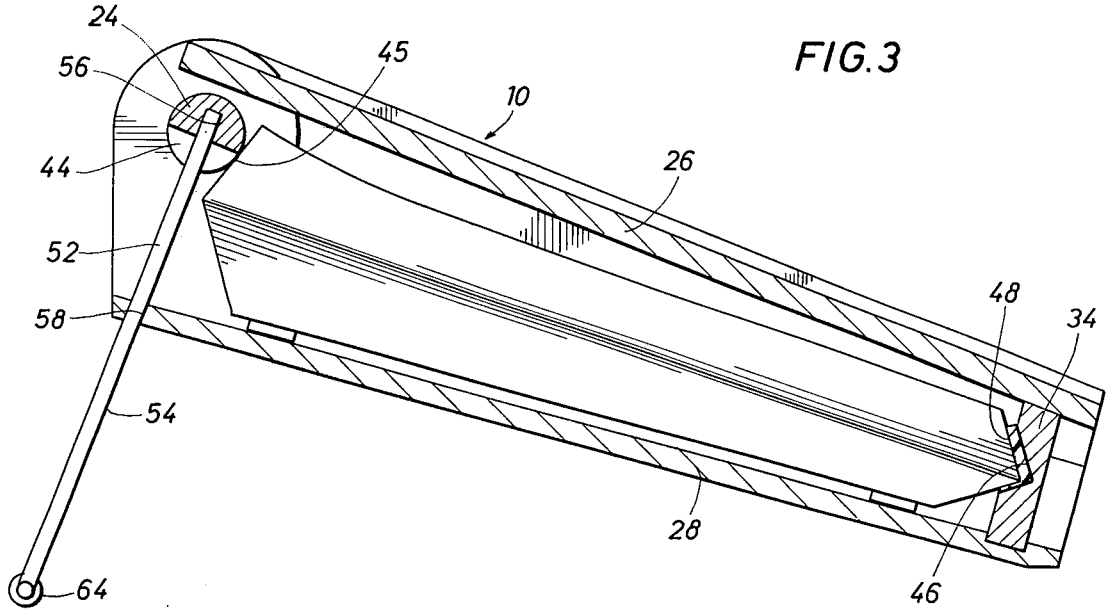
FIG. 3 is a sectional view of the receptacle structure illustrated in FIGS. 1 and 2 with the section being taken along lines 3—3 in FIG. 2 and showing a device such as a calculator being secured within the receptacle.

Referring now to the drawings and first to FIG. 1, a positionable receptacle structure constructed in accordance with the present invention is illustrated generally at 10 and includes a housing 12 within which an object such as a miniature calculator is retained in locked condition in order to prevent the object from being misplaced or taken without authority from a desired location. The housing structure may be provided with a protective cover structure 14 which may be closed as shown in full line in FIG. 1 for the purpose of protecting the object within the receptacle. The cover 14 may be pivoted to a position such as shown in broken line in FIG. 1 for the purpose of exposing the calculator or other object within the receptacle and enabling the object to be used or visually inspected while being secured within the receptacle. The cover element 14 may include a pair of side wall elements 16 and 18, each having a pivot aperture 20 and 22 formed respectively therein and being adapted to be received by opposed pivot end portions of a locking element 24. The locking element 24 and its particular relationship to the structure of the housing and cover portions of the receptacle will be discussed in detail hereinbelow. Each of the side walls of the cover may be machined or otherwise formed to define elongated slots within which may be received the side portions of a cover plate 26 which is shown in FIG. 3. Connection between the side walls 16 and 18 and the cover plate 26 may be accomplished in any suitable way such as by cementing where the side walls and cover plate are constructed of wood or other suitable materials. If desired, the side walls and cover plate may be formed integrally such as might occur upon construction of the receptacle from plastic or metal materials.

The housing structure 12 may be defined by providing a bottom wall 28 to which may be secured a pair of side walls 30 and 32 and an end wall 34. If desired, the lower extremities of the side walls 30 and 32 and the end wall 34 may be received within appropriate elongated slots formed in the bottom wall 28. Likewise, a mechanical interlocked relationship may be established between the end wall 34 and the side walls 30 and 32 by providing slots in the side walls within which the extremities of the end wall 34 may be appropriately received in the manner illustrated in FIG. 2 of the drawings. The particular construction illustrated in FIGS. 1 through 5 of the drawing is not intended to limit the invention in any way, it being intended that the housing structure as well as the cover structure of the enclosure may be formed integrally such as when the receptacle is composed of a material that may be molded such as plastic or metal, for example.

Figure 2:
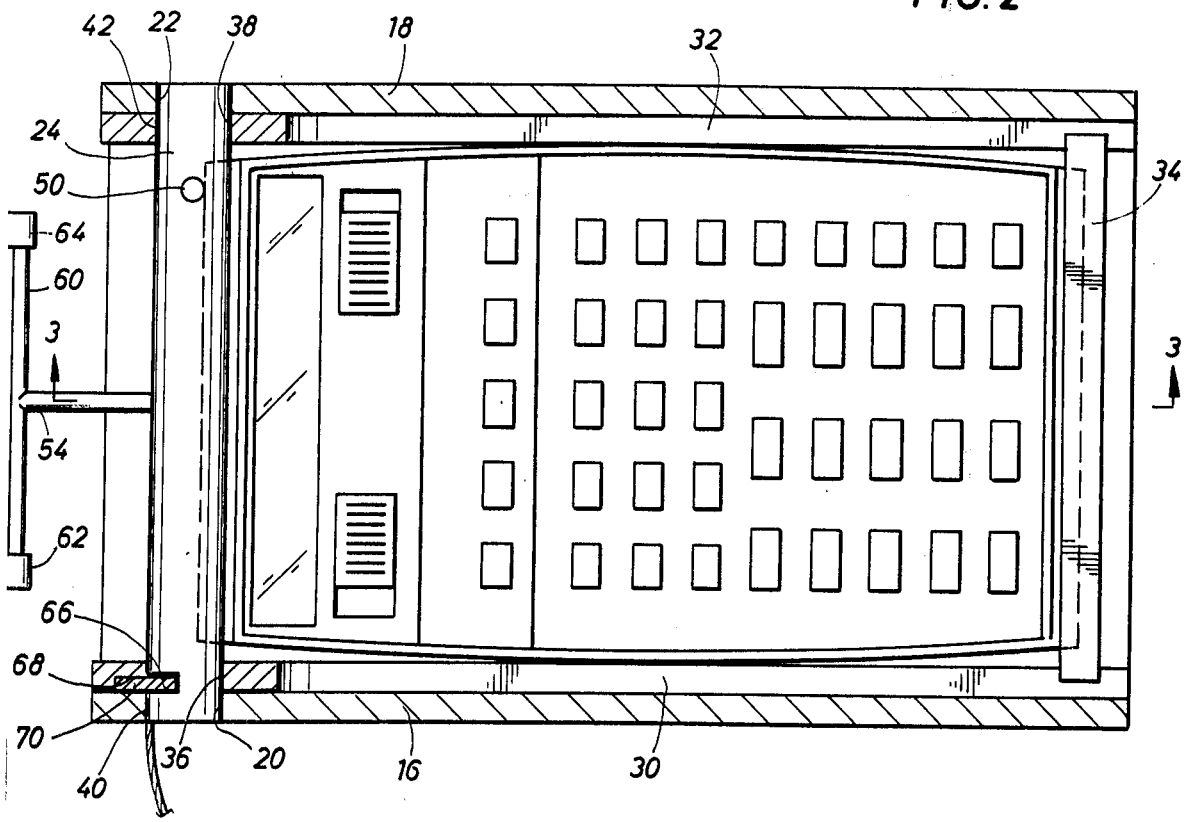
FIG. 2 is a sectional view of the receptacle structure of FIG. 1 with the section being taken along lines 2—2 in FIG. 1 and showing a calculator device being retained within the receptacle.

Side walls 30 and 32 of the housing structure 12 may be formed at one extremity thereof to define apertures 36 and 38 with which the apertures 20 and 22 of the side walls 16 and 18 are disposed in registry. The locking element 24 may be in the form of an elongated generally cylindrical structure defining cylindrical end portions 40 and 42 that are received within the registering apertures at each side of the housing structure 12 as shown in FIG. 2.

Figure 4:
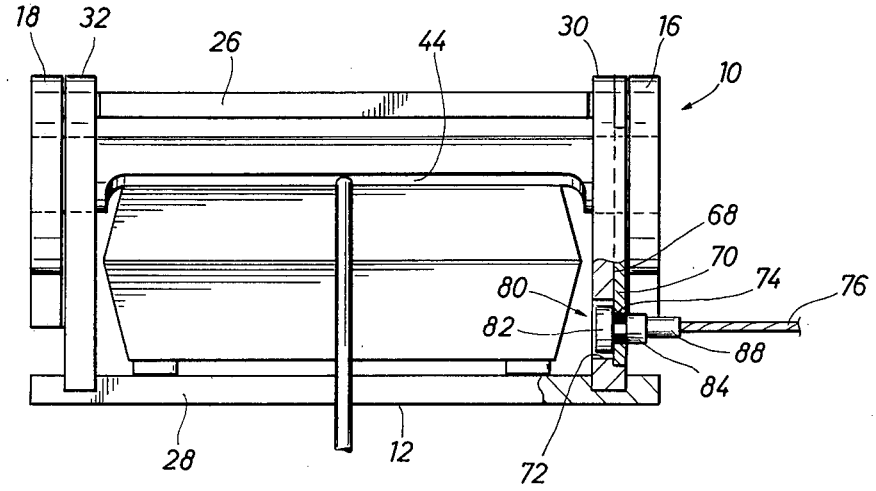
FIG. 4 is also a sectional view with the section being taken along lines 4—4 in FIG. 1 and again showing the relationship of a calculator to the receptacle structure and having a portion of the receptacle structure broken away and illustrating the lanyard and keeper structure of the receptacle in section.
Figure 5:
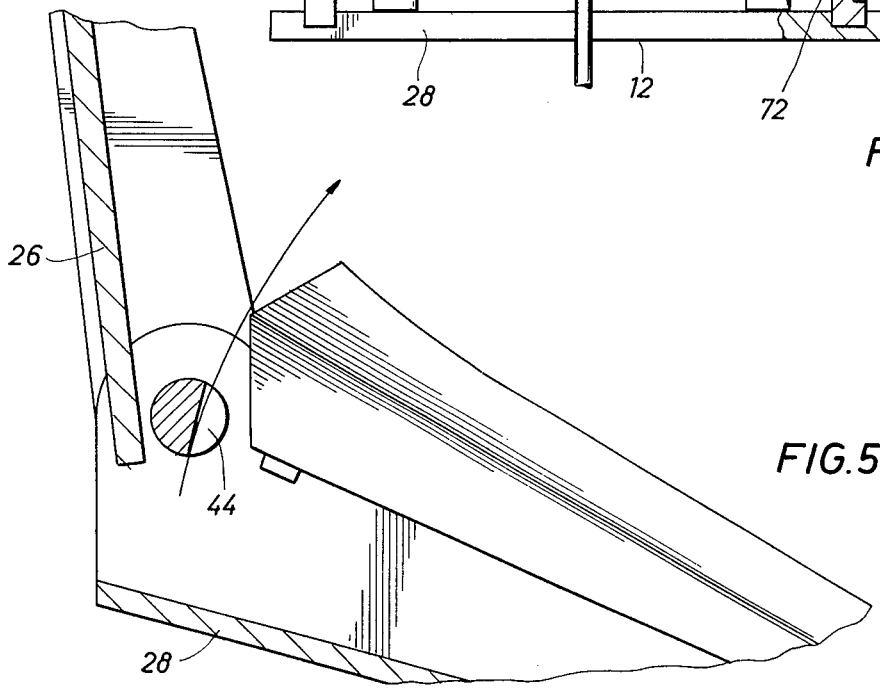
FIG. 5 is a fragmentary sectional view of the receptacle structure of FIGS. 1 through 4 illustrating the locking element in its unlocked position and showing pivotal movement of the calculator to separate it from the receptacle structure.

Intermediate the extremities of the locking element 24, the locking element may be cut away to define a clearance recess 44 such as illustrated in FIGS. 3, 4 and 5. The locking element 24 is rotatable relative to the housing structure between a locked position as shown in FIG. 3, and an unlocked position as shown in FIG. 5. When rotated to the locked position shown in FIG. 3, then locking element establishes contact with the object at point 45 and prevents the object from pivoting clear of the housing structure as shown in FIG. 5. Contact between the locking element 24 and the object 45 may be a simple point contact or line contact depending upon the structure of the object. In the case shown in FIGS. 3, 4 and 5, the object is a miniature calculator having planar inclined end surfaces. In this case, a line contact will be established between the locking element 24 and the object at 45. With the locking element 24 rotated to the unlocked position thereof as shown in FIG. 5, the object may be pivoted through the recess 44 and may be removed from the housing portion of the receptacle.

It is also desirable that the object have a mechanical interlocking relationship with the wall 34 of the housing and, as shown in the drawings, this may be conveniently accomplished by forming the wall 34 in accordance with the configuration of the object. In this case, the calculator has a tapered planar surface that is received within a recess 46 having a mating configuration. Resilient material 48 such as felt, sponge rubber, or the like, may be retained within the recess 46 in order to establish a protective interfitting relationship between the housing structure and the object being retained within the housing.

For movement of the locking element 24 between its locked and unlocked positions, the locking element may be formed to define a bore 50 within which may be received an actuating portion 52 of a locked actuating device 54. The lock actuating device is merely inserted into the aperture 50 and is utilized as a tool to rotate the locking element 24 between its locked and unlocked positions. The locking element 24 may also be formed to define a blind bore 56 within which the actuating extremity of the lock actuating device is received in order that the lock actuating device also serves to elevate one extremity of the housing structure in the manner illustrated in FIGS. 1 and 3. In this case, the actuating portion of the lock actuating device 54 may also extend through an aperture 58 defined in the lower wall 28 of the housing, thereby securing the lock actuating device 54 in a stabilized relationship with the housing 12. At the lower portion of the lock actuating device 54 may be provided a transverse support element 60 having resilient support elements 62 and 64 positioned at the extremities thereof. In the position illustrated in FIGS. 1, 2 and 3, the lock actuating device will also function as a support element that elevates one extremity of housing 12 and allows efficient visual inspection of the object within the housing when the housing is resting on a surface such as a desk, for example.

It is desirable to maintain the locking element 24 in its locked position and to provide means preventing the locking element from being moved to its unlocked position until such movement is authorized. Simple means for selectively immobilizing the locking element 24 may conveniently take the form illustrated, particularly in FIGS. 2 and 4, where the locking element 24 is shown to be formed to define a recess 66 which may be positioned in registry with a recess 68 machined or otherwise formed in the outer surface of the wall structure 30 of the housing. With the slot 66 appropriately oriented in registry with the slot 68, a keeper recess is defined within which may be located a keeper element 70. With the keeper element 70 positioned within the registering slots 66 and 68 of the locking element and housing wall structure, it will be impossible to achieve rotation of the locking element 24 to its unlocked position.

Referring now particularly to FIG. 4, the wall structure 30 of the housing 12 may also be formed to define an aperture 72 which intersects the slot or recess 68 within which the keeper 70 is retained. The keeper 70 is also formed to define an aperture 74 that registers with the aperture 72 of the wall structure 30.

To secure the housing structure with respect to an immovable object such as a desk or other suitable structure, a lanyard device 76 may be provided having a loop 78 defined at the free extremity thereof. Any suitable locking device such as a padlock, for example, may be inserted through the loop of the lanyard 76 to physically lock the housing structure with respect to any suitable immovable device. The lanyard may be defined by a small cable or the like. At the extremity of the lanyard opposite the loop 78 may be provided a locking button 80 having an enlarged head portion or button 82 that is substantially larger than the aperture 74 of the keeper 70 and which is of a size to be received within the aperture 72 of the wall structure 30. An annular shoulder portion 84 may also be defined on the locking button 80 and may be of a size to be received within the aperture 74 of the keeper. Between the enlarged head portion 82 and the annular shoulder portion 84 of the locking button may be defined a reduced diameter portion of sufficient dimension to receive an O-ring 86 that may be received within the aperture 74 when the locking button is properly in place with respect to the wall structure 30 and the keeper 70. The lanyard 76 may be secured to the locking button by the securing portion 88 such as shown in FIG. 4 or by any other suitable means of connection.

In order to rotate the locking element from the locked position shown in FIG. 3 to the unlocked position illustrated in FIG. 5, it will be necessary first to remove the lanyard and locking button from the connection thereof with the housing structure. This can only be accomplished by removing the lock from the loop portion 78 of the lanyard and by removing the lanyard and locking button from connection with the housing. This can be accomplished by moving the lanyard to the left as shown in FIG. 4 to such extent that the lock portion 78 of the lanyard moves through apertures 72 and 74. After this has been accomplished, the keeper 70 may be moved upwardly as shown in FIG. 4 to such extent that the keeper is completely removed from engaging relation with the registering slots 66 and 68 of the locking element and housing. After this has been done, the lock actuating device 54 may be removed from the position illustrated in FIG. 3 and the operating extremity thereof may be inserted into the lock actuating aperture 50.

Using the lock actuating device as a tool, the rotary locking element may simply be rotated approximately 90° counterclockwise as shown in FIGS. 3 and 5, thus positioning the slot 44 in the locking element in a position such as shown in FIG. 5, allowing the calculator or other object to be pivoted outwardly from the housing 12 and removed. This procedure may be reversed, of course, to insert an object such as a calculator into the protective housing structure where it may be secured in place by rotating the locking element clockwise from the position illustrated in FIG. 5 to the position illustrated in FIG. 4, utilizing the lock actuating device as a tool that is inserted into the bore 50. When such rotation is accomplished, the slot 66 of the locking element 24 will become aligned with keeper slot 68 and the keeper element 70 may simply be inserted into the keeper slot as shown in FIGS. 1 and 4. The loop portion 78 of the lanyard then may be inserted through the registering apertures 72 and 74 shown in FIG. 4 and the lanyard may be pulled to the position illustrated in FIG. 4 with the enlarged head portion 82 of the locking button being received within the aperture 72 and engaging the keeper 70. This also positions the O-ring or other suitable friction retaining element 86 within the aperture 74.

In the event the object within the protective receptacle is a portable miniature calculator, the calculator may be effectively used simply by rotating the protective cover 26 to the position illustrated in FIG. 5, thus exposing the upper portion of the calculator for inspection. Of course, the receptacle structure need not include a protective cover such as shown at 26 in the event it should be desirable to leave the receptacle open for inspection.

With the lanyard 76 attached to a fixed object such as a desk by any suitable locking or connection means, it is impossible to remove the calculator or other object from its protective position within the receptacle. In order to remove the calculator it is necessary first to rotate the rotatable locking element 24 to its unlocked position as shown in FIG. 5. Such rotation is impossible with the keeper element 70 in place within the keeper slot 68. The keeper 70 cannot be removed from its slot until such time as the lanyard 76 is unlocked from its connection with the fixed object and withdrawn completely through the aperture 74. Thus, with the lanyard 76 locked to any fixed object, the protective receptacle will remain connected to the fixed object and the calculator or other protected object will be caused to be retained within the protective receptacle. The protective receptacle and calculator or other object will be retained for ready use and will not readily become misplaced by personnel using same. Additionally, the lock actuating device 54 will effectively elevate one extremity of the protective receptacle, thereby allowing the calculator or other object to be readily inspected and used. Additionally, the lock actuating device 54 may be slightly rotated from the positon illustrated in FIGS. 1, 2 and 3, thereby positioning the transverse base portion 60 thereof in angular relationship with the longitudinal axis of the rotatable locking element 24. In this manner, the protective rest portions 62 and 64 will be positioned at different elevations relative to the protective receptacle and will accommodate positioning of the protective receptacle on an inclined or uneven surface. In this manner, the protective receptacle may be very effectively stabilized regardless of the orientation or configuration of the surface upon which the protective receptacle rests.

With reference now to FIGS. 6 and 7, it is evident that the protective receptacle of the present invention may take other convenient forms, one such form being illustrated in FIGS. 6 and 7. The protective receptacle illustrated generally at 90 may incorporate a receptacle housing 92 defined by side walls 94 and 96 to which a bottom wall 98 may be interconnected with side portions of the bottom wall 98 being received within elongated grooves 100 and 102. The protective receptacle may also include end walls, one of which is shown at 104 having its bottom edge portion received within an elongated slot 106 formed in a bottom wall 98. The opposite end wall, now shown, may conveniently take the form illustrated in FIG. 3 at 34 in order to provide a structurally interlocked relationship with one extremity of the calculator or other object being retained within the protective receptacle.

A pivotal cover element may also be provided incorporating side walls 108 and 110 that are connected by pivots 112 and 114 to the side walls 96 and 94, respectively, of the protective receptacle. The cover may also include an upper protective cover plate 116 that is connected in any suitable manner to the side walls 108 and 110.

For the purpose of retaining the calculator or other object in place within the protective receptacle a locking retainer element 118 may be provided having an upper curved extremity 120, within which may be received a flexible tubular cushion element 122 that engages one surface of the calculator or other object retained within the receptacle and prevents the calculator or other object from being removed from the receptacle. The locking retainer element 118 may be formed to define a depending tab element 124 that may extend through an elongated opening 126 defined within the bottom wall 98 of the receptacle. The depending tab 124 may be formed to define an aperture 128 that is positioned at or very near the lower surface 130 of the bottom wall 198 and which is adapted to receive a lanyard 132 that may be utilized to secure the protective receptacle to a fixed object such as a desk. The lanyard 132 may be provided with an enlarged terminal button 134 that is larger than the dimension of the aperture 128 and prevents the lanyard from being removed from the aperture until the opposite extremity of the lanyard has been disconnected from the fixed object. The locking retainer 118 may not be removed from the slot 126 of the bottom wall 98 until the lanyard has been completely withdrawn through the aperture 128. As long as the locking retainer element 118 remains in place it is impossible to remove the calculator from its locked position within the protective receptacle.

A further embodiment of the present invention may conveniently take the form illustrated in FIG. 8 where a protective receptacle structure generally illustrated at 140 may include a housing structure defined by a bottom wall 142 to which side walls 144 and 146 may be connected in any suitable manner. Side wall 146 may be formed to define a keeper recess 148 within which may be retained a keeper element 150. A crank-like locking element 152 may also be provided having coaxial end portions 154 and 156 and an offset locking portion 158. Portions of the side walls 144 and 146 and side walls 160 and 162 of a pivotal protective cover may be formed to define registering apertures 164 and 166 within which the end portions 154 and 156 are respectively rotatably received. The locking element 152 is therefore rotatable to a locking position as shown in FIG. 8 where the locking portion 158 thereof engages one extremity of the calculator or other object to retain the calculator in locked condition within the protective receptacle. The locking element 152 is also rotatable to an unlocked position such that the locking portion 158 thereof is removed from engagement with the calculator and allows the calculator to be pivoted upwardly in the manner shown in FIG. 5 so that it may be removed from the protective receptacle.

In order to prevent the locking element 152 from being rotated to the unlocked position until such movement is desired, the end portion 156 of the locking element may be formed to define a keeper slot 168 that may be positioned in registry with the recess 148 such that the keeper 150 may be inserted into the keeper slot. With the keeper in position as shown in FIG. 8, it is impossible to rotate the locking element due to the structural interrelation between the keeper, the keeper recess, and the rotatable end portion 156 of the locking element. The keeper element 150 and the side wall 146 of the protective receptacle may be formed to define registering apertures that collectively define an aperture 170 through which a lanyard 172 may extend. The lanyard 172 may be constructed in similar manner as the lanyard 76 shown in FIG. 4 and may be provided to retain the keeper 150 in place until such time as the lanyard has been unlocked from its connection with a fixed object.

An even further embodiment of the present invention may be constructed in the manner illustrated in FIG. 10 where a protective receptacle generally illustrated at 174 includes a housing structure defined by a pair of side walls 176 that are formed to define elongated grooves that receive a slidable bottom wall 178. A shoulder element 180 may also be fixedly positioned between the side walls immediately above the grooves that receive the bottom wall 178. The bottom wall 178 may be formed to define an aperture 182 within which may be received the head portion 184 of a lanyard element 186 that may be utilized in the manner discussed hereinabove for connection of the protective receptacle to any fixed object such as a desk, for example. The lanyard 186 will extend through the clearance defined between the shoulder element 180 and the calculator or other object retained within the receptacle. The receptacle will also be provided with an end wall engaging the opposite extremity of the calculator or other object which end wall structure may be constructed in a similar manner as the end wall 34 illustrated in FIG. 3. Likewise, the protective receptacle or enclosure may also be provided with a pivotal cover 188 that pivots about a pivot element 190 extending through apertures 192 formed in the side walls 176. The pivot element 190 also serves to prevent the calculator or other object within the protective receptacle from being withdrawn linearly or pivoted upwardly in the manner discussed above in connection with FIGS. 1 through 3. The transverse bar defining shoulder element 180 provides a stop shoulder to prevent the lanyard 186 from being withdrawn through the open front extremity of the protective receptacle. The lanyard, with the button 184 in place as shown in FIG. 10 or with the lanyard simply extending through the aperture 182 in the slidable bottom wall 178, will prevent the bottom wall from being removed from the grooves that retain it in assembly with the side walls 176. The bottom wall may be slidably removed from the receptacle structure only after the lanyard has been unlocked from its connection with the desk or other relatively immovable structure and has been withdrawn through the aperture 182.

Upon removal of the bottom wall 178, the calculator or other object may be removed from the receptacle simply by pivoting it downwardly through an arc shown in broken lines in FIG. 10 to such extend that one extremity of the calculator pivots clear of the shoulder defined by element 180. One extremity of the protective receptacle, being open, effectively promotes connection of the calculator circuitry to an external power source.

Referring now to FIG. 11, the present invention may conveniently take the form of a protective receptacle that is basically formed from sheet material such as metal or plastic, which may be bent or otherwise formed to a configuration capable of having a cooperative locking relationship with a calculator or other object to be retained therein. As shown in FIG. 11, a single sheet of material defining the receptacle generally illustrated at 194 may be formed to define side walls 196 and 198 and an integral bottom wall 200. Pad elements 202 may be secured in any desirable manner to the lower surface of the bottom wall 200 and may provide non-scuffing support for the receptacle on any surface. As shown at the right hand portion of FIG. 11, the sheet material of the protective receptacle 194 may be bent upwardly to define an angulated wall 204 that is adapted to engage one extremity of the calculator or other object retained within the receptacle. If desired, resilient material 206 may be secured to the inner surface of the wall 204 for engagement with the calculator to protect the calculator structure from scuffing or other damage.

To provide for the establishment of a locked relationship between the calculator and the protective receptacle structure, side walls 196 and 198 may be formed to define registering slots 208 and 210, respectively, that are adapted to receive a locking element 212 that extends therethrough in the manner illustrated in FIG. 12. As shown in FIG 13, the locking element 212 may be formed to define an elongated portion 214 having a retainer tab 216 formed at one extremity thereof. The opposite extremity of the locking element 212 may be formed to define an aperture 218 through which a retaining lanyard 220 may extend. The lanyard 220 may be formed to define a loop 222 at one extremity thereof to facilitate attachment of the lanyard to any suitable object, such as a desk, drafting table, etc. At the opposite extremity of the lanyard 220 may be provided a retainer button 224 that is received within the aperture 218 to prevent separation of the lanyard 220 from the locking element 212. An enlarged head 226 may be defined on the button 224 to prevent the locking button from being withdrawn from the locking element 212 through the locking aperture.

It may become desirable to provide means for elevating one extremity of the protective receptacle in order that the calculator or other object may be more readily visible to persons using the same. In accordance with the present invention, such may be accomplished by providing a suitable receptacle at one extremity of the protective receptacle that is capable of receiving an elevating stand device, such as shown at 228 in FIG. 11. The receptacle structure may conveniently take the form of a structural body 230 that may be connected to the bottom wall 200 of the protective receptacle in any suitable manner. The body 230 may be formed to define an internal receptacle 232 that may be positioned in registry with an aperture 234 formed in the bottom wall of the protective receptacle. The elevating stand may be inserted through the aperture 234 into the receptacle 232 to provide suitable connection between the protective receptacle and the elevating stand. If desired, the elevating stand may conveniently take a form such as the combination elevating stand and lock actuating device 54 illustrated in FIGS. 1 through 3.

With the locking element 212 removed from the apertures 208 and 210 of the protective receptacle 194, the calculator or other suitable object may be inserted into the protective receptacle bringing one extremity thereof into engagement with the resilient pad 206 supported by the inclined end wall 204. Logically, the end wall 204 may take any other suitable form capable of establishing a locking relationship with the calculator or other object to be retained within the receptacle. After the calculator has been positioned within the protective receptacle, the elongated locking portion 214 of the locking element 212 may be inserted through the registering apertures 208 and 210 of side walls 196 and 198 bringing the locking tab portion 216 thereof into engagement with side wall 198. After this has been done, the loop portion 222 of the lanyard 220 may be inserted through the aperture 218 and the locking button 224 of the lanyard may be inserted into the aperture 218 bringing the enlarged head portion 226 into engagement with the elongated locking portion 214. The enlarged head portion prevents the locking button from being withdrawn from the locking element 212 without first releasing the connection between the loop portion 222 of the lanyard and the object to which the loop may be fixed. The loop portion of the lanyard then may be connected to a desk or table by a padlock or other suitable locking device.

In view of the foregoing, it is apparent that I have provided a novel protective receptacle structure for small portable objects such as miniature calculators and the like that enables such objects to be movably retained in connection with a relatively immovable object such as a desk, drafting table, or the like. An elongated lanyard is provided that can be secured to the desk or other object by a padlock or other suitable lock device and the protective receptacle with its retained object may be readily moved about a fairly large area for efficient use. Through utilization of the simple protective receptacle, the object will not become readily lost or misplaced and it is extremely difficult for the receptacle to be taken away from the local area circumscribed by the lanyard securing device. Also, the object may be prevented by the protective receptacle from falling from a desk to the floor where it may become damaged. The protective receptacle structure also provides for quick release of the calculator or other object from the protective receptacle in the event it becomes desirable to separate the calculator from the receptacle for transportion elsewhere. Also, the protective receptacle itself with the calculator contained therein may be easily separated from the object to which it is retained and may be transported from the local area if desired. The protective receptacle is also capable of being elevated at one extremity thereof in order to enable the user to more readily visualize the miniature calculator or other object contained therein.

It is therefore readily apparent that my invention is one well adapted to attain all of the features and advantages hereinabove set forth, together with other advantages which will become obvious and inherent from a description of the apparatus itself. It will be understood that certain combinations and sub-combinations are of utility and may be employed without reference to other features and sub-combinations. This is contemplated by and is within the scope of the present invention.

As many possible embodiments may be made of this invention without departing from the spirit and scope thereof, it is to be understood that all matters hereinabove set forth or shown in the accompanying drawings are to be interpreted as illustrative and not in any limiting sense.

What is claimed is:

1. A receptacle for lockably and releasably retaining an article therein, said receptacle comprising:

wall structure defining a depression within which said article is receivable;

locking means establishing an interlocking relation with said receptacle and for establishing an interlocking relationship with an article for securing said article against separation from said receptacle, said receptacle defining an open portion to expose said article for use when so secured within said receptacle;

keeper means being releasably positionable in cooperative relationship with said wall structure and said locking means in the locked position of said locking means, said keeper means retaining said locking means in said locked position; and retainer means for securing said keeper means in said cooperative relationship with said wall structure.

2. The receptacle described in claim 1, wherein said retainer means comprises:

an elongated flexible securing element defining a retaining extremity and a securing extremity;

said retaining extremity being simultaneously receivable in retaining engagement with said keeper means and said wall structure; and said securing extremity being securable to a relatively immovable object.

3. The receptacle described in claim 1, wherein:

said keeper means defines a keeper extremity and a securing extremity and said keeper means is positionable in interfitting relationship with said wall structure;

said securing extremity being retained with said wall structure by receiving said retainer means in retaining engagement therewith; and said keeper extremity being receivable in retaining engagement with said locking means.

4. The receptacle described in claim 1, wherein:

said keeper means defines a keeper extremity and a securing extremity and is formed to define an aperture at the securing extremity thereof;

said wall structure defining an aperture with which said aperture of said keeper means is registrable;

said retainer means being an elongated securing element having a locking button at one extremity thereof and defining a keeper extremity at the opposite extremity thereof;

said registrable apertures receiving said locking button of said elongated securing element and said locking button maintaining said keeper means in a secured position for preventing movement of said keeper means;

said locking means defining a retaining slot; and said keeper extremity of said keeper means being received by said retaining slot simultaneous with receiving said elongated securing element in a secured position wherein said locking means is retained in the locked position.

5. The receptacle described in claim 1, wherein:

said locking means is an elongated member defining a retaining extremity, a free exremity, and a locking surface;

said retaining extremity receiving said keeper means in retaining engagement therein when said locking means is in the locked position; and said locking surface cooperating with said wall structure to retain said article in locked condition within said defined depression when said locking means is in the locked position.

6. A receptacle for lockably and releasably retaining an article therein, said receptacle comprising:

wall structure defining a depression within which said article is receivable;

locking means for securing said article within said receptacle, said locking means including an elongated member defining a flat locking surface along a part of its axial length and a retaining slot at one end and having a free end;

said flat locking surface cooperating with said wall structure and with said article to retain said article within said defined depression when said locking means is in the locked position;

keeper means being releasably positionable in cooperative relationship with said wall structure and said locking means in the locked position of said locking means, said keeper means retaining said locking means in said locked position;

said keeper means being received by said retaining slot and retaining said locking means in the locked position thereof; and retainer means for securing said keeper means in said cooperative relationship with said wall structure.

7. The receptacle described in claim 6, wherein said locking means is a rotatable elongated member.

8. The receptacle described in claim 1, wherein:

said locking means is an elongated element defining a locking surface; and said wall structure cooperates with said locking surface of said locking means to retain an article within said defined depression when said locking means is in the locked position.

9. A receptacle as recited in claim 1, wherein said retainer means comprises:

an elongated securing element defining a retaining extremity, and a securing extremity, said retaining extremity being receivable in retaining engagement with said keeper means and said wall structure and said securing extremity being securable to a relatively immovable object.

10. A receptacle as recited in claim 1, wherein said retainer means comprises:

an elongated lanyard having a locking button at one extremity thereof and securing means at the opposite extremity thereof;

said keeper means and said wall structure having registrable apertures; and said locking button of said lanyard being receivable within said registrable apertures and preventing separation of said keeper element from said wall structure.

11. A receptacle as recited in claim 1, wherein:

said wall structure and said locking means cooperate to define keeper receiving means in the locked position of said locking means; and said keeper means being receivable within said keeper receiving means only when said locking means is in the locked position thereof.

12. A receptacle for lockably and releasably retaining an article therein, said receptacle comprising:

wall structure defining a depression within which said article is receivable and having an aperture formed therein;

locking means for securing said article within said receptacle;

keeper means being releasably positionable in cooperative relationship with said wall structure and said locking means in the locked position of said locking means, said keeper means retaining said locking means in said locked position, said keeper means defining an aperture for registery with said aperture of said wall structure;

retainer means for securing said keeper means in said cooperative relationship with said wall structure;

said retainer means being an elongated lanyard having a locking button at one extremity thereof and a securing means at the opposite extremity thereof;

said locking button of said lanyard being receivable within said registerable apertures and preventing appreciable movement of said keeper means in relation to said wall structure.

13. The receptacle described in claim 12, wherein said locking button is exclusively insertable and removable from said registrable apertures opposite said securing extremity.

* * * * *